United States Patent [19]

Simonazzi

[11] Patent Number: 4,711,276

[45] Date of Patent: Dec. 8, 1987

[54] FILLING DEVICE WITH INTERCHANGEABLE VALVE MEMBER FOR CANS OF DIFFERENT DIAMETERS

[76] Inventor: Adriano Simonazzi, Via La Spezia 241/a, 43016 Parma, Italy

[21] Appl. No.: 854,974

[22] Filed: Apr. 23, 1986

[30] Foreign Application Priority Data

Apr. 29, 1985 [IT] Italy ..... 3422 A/85

[51] Int. Cl.[4] ..... B67C 3/34

[52] U.S. Cl. ..... 141/286; 141/292; 141/367; 141/294

[58] Field of Search ..... 141/152, 367, 368, 285–310, 141/1–12, 37–66, 129–151, 153–192, 392, 115, 311 A, 250–284

[56] References Cited

U.S. PATENT DOCUMENTS 596,606 1/1898 Middlekauff ..... 141/298

*Primary Examiner*—Houston S. Bell, Jr.

*Attorney, Agent, or Firm*—Sughrue, Mion, Zinn, Macpeak, and Seas

[57] ABSTRACT

A filling device for cans is provided with a cylindrical filling tube having a valve member moveable coaxially therein with complementary projections on the interior surface of the filling tube and the valve member to define a fluid shut off and to define related surfaces to provide the circumferential laminar flow of fluid into a can whereby the residual fluid remaining after the closing of the valve will not drip due to surface tension. A cylindrical valve member is slidably mounted in a housing surrounding the filling tube and is provided with a sealing ring at the lower end for engaging the rim of a can to be filled. Depending on the diameter of the cylindrical valve member a bearing sleeve having an appropriate radial thickness can be inserted in the housing to take up the slack.

5 Claims, 6 Drawing Figures

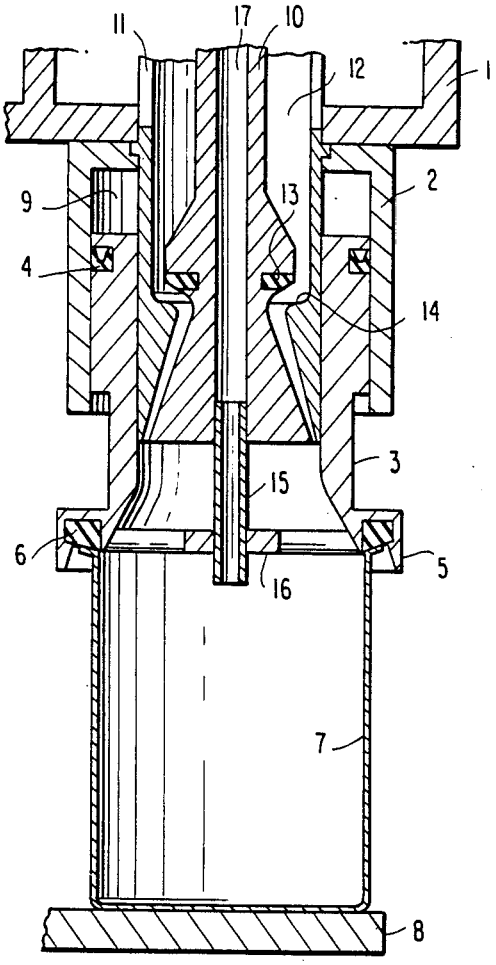
FIG. 1
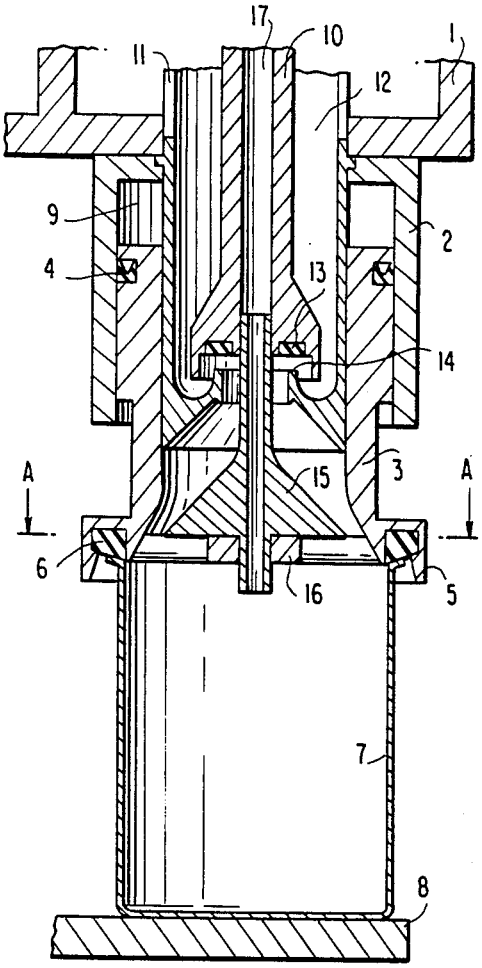
FIG. 2
FIG. 3
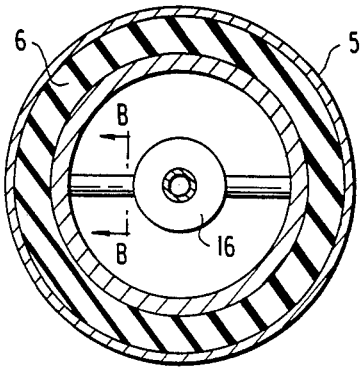
FIG. 4
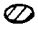

FILLING DEVICE WITH INTERCHANGEABLE VALVE MEMBER FOR CANS OF DIFFERENT DIAMETERS

BACKGROUND OF THE INVENTION

The present invention is directed to a device for filling cans and more specifically to a device for controlling the circumferential laminar flow of fluid into a can through an interchangeable valve member for accommodating cans of different diameters.

Various types of filling devices for cans are known in the art, all of which have the disadvantage of being adapted for a single type of can having a specific diameter. Thus the the entire filling device must be changed whenever there is a change in the diameter of the can to be filled. Indeed none of the known filling devices allow the adjustment of the differential thrust with which the seal between the filling device and the edge of the can is insured, which also can vary along with the diameter of the valve. In addition, the prior art filling devices utilize a wire gauze to prevent the dripping of the liquid by increasing the hydrodynamic resistance thus preventing the residual mass of fluid from passing therethrough.

SUMMARY OF THE INVENTION

The present invention provides a new and improved filling device for cans wherein a tubular cylinder defining the inlet conduit and a valve member moveable coaxially therein are provided with complementary configurations for maximizing the laminar nature of the flow and eliminating dripping upon closing of the inlet passage.

The present invention provides a new and improved filling device for cans wherein the valve for maintaining a sealed contact between the rim of a can and the filling device may be removably mounted in a housing to allow the use of other valves having different diameter sealing means thereon for engagement with the rims of cans of different diameters.

The present invention provides a new and improved filling device for cans comprising cylinder means defining an input passage having annular valve seat means formed thereon, valve means moveable coaxially within said cylinder means and having annular sealing means adapted to be brought into and out of engagement with said valve seat on axial movement of said valve means, air passage means extending axially of said valve means adapted to extend into the can to be filled, conical flange means surrounding said air passage means for creating a circumferential laminar flow of a fluid into a can, cylindrical housing means coaxially arranged about said cylinder means to define an annular chamber, cylindrical valve means removably and slidably mounted in said chamber and extending axially outwardly thereof beyond the end of said cylinder means, annular sealing means on the end of said cylindrical valve means having a diameter commensurate with the diameter of a can to be filled and means for supporting a can in coaxial alignment with said filling device for engagement with said sealing means upon relative axial movement of said cylindrical valve means and said can.

The foregoing and other objects, features and advantages of the invention will be apparent from the following more particular description of preferred embodiments of the invention as illustrated in the accompanying drawings.

BRIEF DESCRIPTION OF THE DRAWINGS

FIG. 1 is a vertical side elevation view in cross section of a filling device for cans with the components disposed in the filling phase.

FIG. 2 is a vertical side elevational view in cross section of a modified filling device with the elements thereof disposed in the filling phase.

FIG. 3 is a transverse sectional view taken along the line A—A as illustrated in FIG. 2.

FIG. 4 is a detailed transverse sectional view taken along the line B—B as illustrated in FIG. 3.

DETAILED DESCRIPTION OF THE INVENTION

Figure 5:
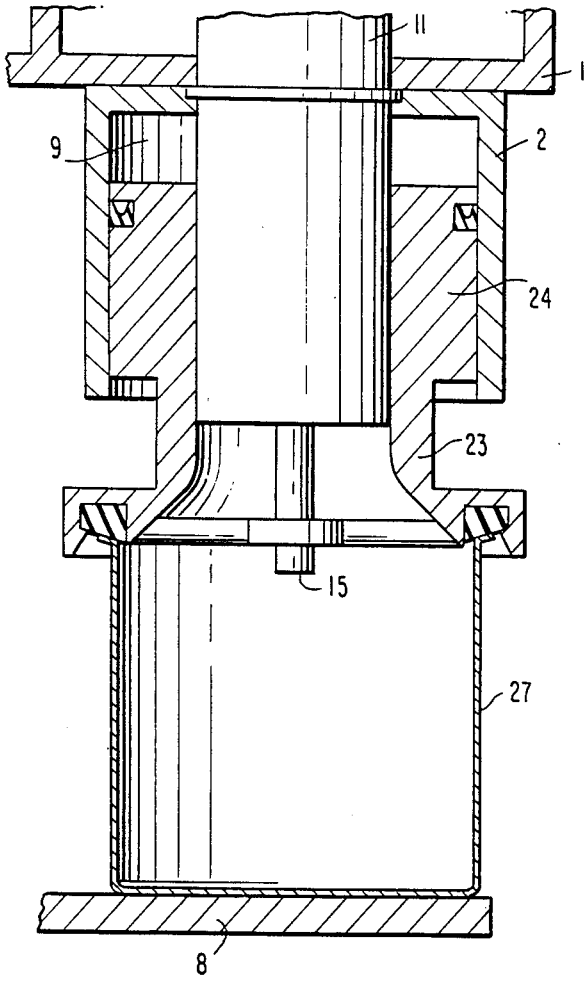
FIG. 5 is a side elevational view in section of a filling device having a sealing valve of a diameter to accommodate large diameter cans.

The filling device as illustrated in FIG. 1 is comprised of a hollow cylindrical filling tube 11 which is carried by a main support 1 and which extends downwardly therefrom with the axis of the tube being vertically disposed. A valve member 10 is coaxially disposed within the filling tube 11 and is provided with a coaxial air passage 17 extending the entire length thereof. The filling tube 11 is provided with an annular projection 14 defining a valve seat and the valve member 10 is provided with a complementary annular projection having an annular sealing ring 13 mounted therein for engagement with the valve seat 14. The lower end of the valve member 10 is provided with a conical flange which is disposed opposite an inverted conical surface integral with the valve seat 14 and extending downwardly therefrom. The two conical surfaces are disposed at different angles with respect to the vertical axis of the filling tube to define a downwardly tapered passage which will define a laminar circumferential flow of a fluid being introduced into a can 7 carried by a suitable support 8.

A hollow cylindrical housing 2 is secured to the main support 1 coaxially and outwardly of the filling tube 11 to define a downwardly open thrust chamber 9. A hollow cylindrical valve 3 is slidably disposed within the thrust chamber 9 and an annular sealing ring is provided on the external surface of the valve 3 so that the valve 3 is in sliding sealed engagement with the housing 2. The lower end of the valve 3 projects beyond the lower end of the filling tube 11 and is provided with a downwardly open annular recess having a sealing ring 6 secured therein for engagement with the upper rim of a can 7. A hollow pipe 15 is slidably mounted in the air passage 17 to provide an extension thereof with the lower end of the pipe 15 adapted to extend into the interior of the can 7. The pipe 15 is supported by means of the web 16 integral with the lower end of the valve 3. Upon upward movement of the support 8 the upper rim of the can 7 will be brought into sealing engagement with the sealing ring 6 and the air trapped in the thrust chamber 9 will insure a tight sealing arrangement between the valve and the rim of the can. Upon moving the valve member 10 downwardly to bring the sealing ring 13 in sealing engagement with the valve seat 14 the flow of fluid will be terminated and the residual fluid on the conical surfaces will be prevented from dripping due to surface tension.

The embodiment of FIG. 2 is similar to the embodiment of FIG. 1 except for a variation in the configuration of the valve seat 14 and the complementary configuration of the valve member having the sealing ring 13 therein. Also the conical flange for providing a circumferential laminar flow of the fluid is integral with the air passage extension 15 instead of being integral with the valve member 10.

Figure 6:
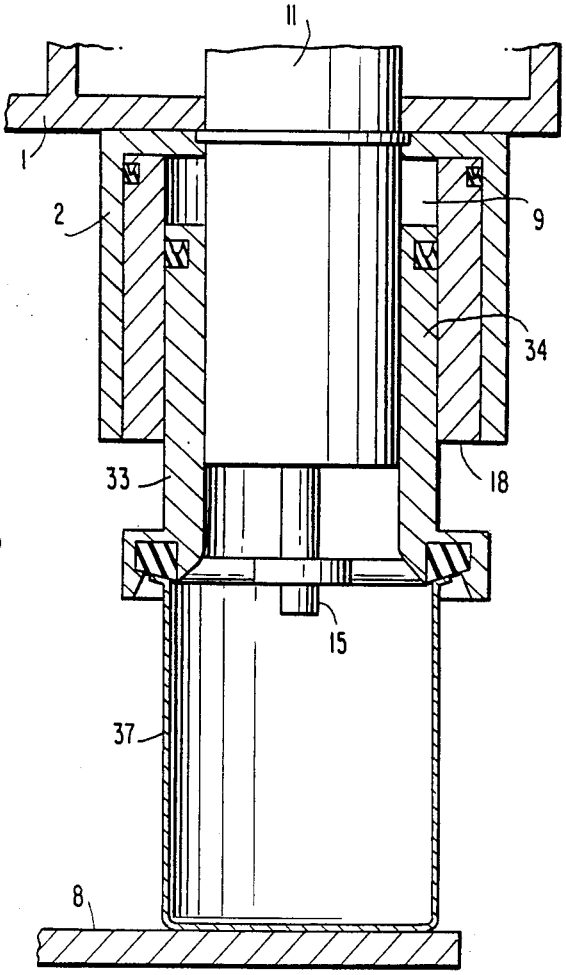
FIG. 6 is a side elevational view in section of a filling device having a sealing valve adapted to accommodate cans having a smaller diameter than the diameter of the can shown in FIG. 5.

The embodiment of FIG. 5 shows a filling device similar to that illustrated in FIG. 1 with the exception of the valve 23 and the housing 2 in which the valve 23 is slidably mounted. In FIG. 5 the outer diameters of the valve 23 and the housing 2 are considerably larger than the corresponding diameters shown in FIG. 1 in order to accommodate a can 27 having a larger diameter than the can 7 shown in FIG. 1. The portion of the valve 23 which is slidable within the housing 2 has a considerably greater radial thickness than the corresponding portion of the valve 3 in FIG. 1. If it is desired to fill a can 37 having a smaller diameter than the can 27 the same housing 2 as illustrated in FIG. 5 may be utilized and a valve 33 having a smaller diameter to accommodate a smaller diameter can 37 is slidably mounted in contact with the filling tube 11 and a filler sleeve or bearing 18 is inserted in the housing 2 to make up the difference as illustrated in FIG. 6. Thus the valve 3 having the smaller sealing diameter at the lower end thereof is slidably mounted in sealing engagement with the filler sleeve 18 which in turn is disposed in sealing engagement with the internal surface of the housing 2.

In other words, the valve 23 in FIG. 5 is provided with a sliding portion 24 having a radial thickness equal to the radial dimension of the annular thrust chamber 9 for sliding engagement therein. In FIG. 6 the cylindrical valve member 33 is provided with a sliding portion 34 having a radial thickness less than the radial dimension of the annular chamber 9 and the bearing member 18 is removably secured in the annular thrust chamber 9 and has a radial thickness equal to the difference between the radial dimension of the annular thrust chamber 9 and the radial thickness of the sliding portion 34 of the cylindrical valve member 33.

The invention can lend itself to different variations and practical applications with respect to the structural proportions, technological selections of assembly materials, as well as the adoption of the necessary improvements. With the description of the original combinations as presented, one skilled in the art can assemble filling devices with interchangeable valves for cans having different diameters with the basic characteristics essentially described, illustrated and set forth in the following claims.

What is claimed:

1. A filling device for cans having different diameters comprising:

filling means including a cylindrical filling tube having valve means and air passage means disposed therein;

a downwardly opening cylindrical housing surrounding said filling means coaxially therewith and defining an annular thrust chamber therebetween; and a cylindrical valve member slidably mounted in said thrust chamber and having sealing means at the lower end thereof adapted to engage the upper rim of a can supported below the filling tube.

2. A filling device for cans as set forth in claim 1 wherein said cylindrical valve member is provided with a sliding portion having a radial thickness equal to the radial dimension of said annular thrust chamber for sliding engagement therein.

3. A filling device for cans as set forth in claim 1 wherein said cylindrical valve member is provided with a sliding portion having a radial thickness less than the radial dimension of said annular chamber and further comprising an annular bearing member removably secured in said annular thrust chamber and having a radial thickness equal to the difference between the radial dimension of said annular thrust chamber and the radial thickness of said sliding portion of said cylindrical valve member.

4. A filling device for cans as set forth in claim 1 wherein said valve means and air passage means include flange means to provide a circumferential flow of fluid into a can.

5. A filling device for cans as set forth in claim 4 further comprising projecting means on the inner surface of said cylindrical filling tube which in cooperation with said flange means define a fluid passage whereby the residual fluid in said passage subsequent to closing of said valve means will not drip due to the surface tension of the residual fluid.

* * * * *